US009673550B2

(12) United States Patent
Trinh et al.

(10) Patent No.: US 9,673,550 B2
(45) Date of Patent: Jun. 6, 2017

(54) ELECTRICAL CONNECTING MODULE

(75) Inventors: Dat-Minh Trinh, Barntrup (DE); Markus Becker, Paderborn (DE); Roland Tombers, Paderborn (DE); Markus Hanses, Hoxler (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 178 days.

(21) Appl. No.: 14/126,843

(22) PCT Filed: Jun. 13, 2012

(86) PCT No.: PCT/EP2012/002499

§ 371 (c)(1),
(2), (4) Date: Jan. 15, 2014

(87) PCT Pub. No.: WO2012/171640

PCT Pub. Date: Dec. 20, 2012

(65) Prior Publication Data

US 2014/0213117 A1 Jul. 31, 2014

(30) Foreign Application Priority Data

Jun. 17, 2011 (DE) ..... 10 2011 105 156
May 29, 2012 (DE) ..... 10 2012 010 391

(51) Int. Cl.
*H01R 13/20* (2006.01)
*H01R 13/506* (2006.01)
(Continued)

(52) U.S. Cl.
CPC ..... *H01R 13/20* (2013.01); *H01R 9/26* (2013.01); *H01R 13/506* (2013.01); *H01R 13/512* (2013.01)

(58) Field of Classification Search
CPC .. H01R 13/20; H01R 13/6586; H01R 13/518; H01R 9/26; H01R 9/2675
(Continued)

(56) References Cited

U.S. PATENT DOCUMENTS 3,576,520 A * 4/1971 Stauffer ..... 439/716
4,472,764 A * 9/1984 Richard ..... H01R 9/2625 361/775
(Continued)

FOREIGN PATENT DOCUMENTS

CN 1423369 A 6/2003
CN 1452273 A 10/2003
(Continued)

*Primary Examiner* — Amy Cohen Johnson
*Assistant Examiner* — Oscar C Jimenez
(74) *Attorney, Agent, or Firm* — Mannava & Kang, P.C.; Arash Behravesh

(57) ABSTRACT

The invention relates to an electrical connecting module comprising: a module housing (101), which comprises a module receptacle (103, 119, 1209) with a first electrical connection terminal (105, 107); a module element (109, 1205) with a second electrical connection terminal (111, 113) and with a third electrical connection terminal (115, 117), wherein the module element (109, 1205) for electrically connecting the first connection terminal (105, 107) to the second connection terminal (111, 113) can be inserted (into the module receptacle (103, 119, 1209) and can be held in the module receptacle (103, 119, 1209) by means of a detachable latching connection; and a release device (125) for releasing the latching connection.

20 Claims, 28 Drawing Sheets

(51) Int. Cl.
*H01R 9/26* (2006.01)
*H01R 13/512* (2006.01)

(58) Field of Classification Search
USPC ..... 439/660, 715, 716
See application file for complete search history.

(56) References Cited

U.S. PATENT DOCUMENTS

| | | | | |
|---|---|---|---|---|
| 5,222,897 | A | 6/1993 | Collins et al. | |
| 6,027,379 | A * | 2/2000 | Hohorst | 439/715 |
| 6,456,495 | B1 | 9/2002 | Wieloch et al. | |
| 6,733,347 | B2 * | 5/2004 | Palet Mercader et al. | 439/810 |
| 6,806,424 | B2 * | 10/2004 | Gerving | 174/59 |
| 6,832,935 | B2 * | 12/2004 | Minowa | H01R 9/2608 361/759 |
| 6,893,280 | B2 * | 5/2005 | Thompson | H01R 4/2433 439/276 |
| 6,940,021 | B2 * | 9/2005 | Pohl | H01H 9/10 174/137 R |
| 7,775,806 | B2 * | 8/2010 | Heggemann et al. | 439/76.1 |
| 8,128,435 | B2 * | 3/2012 | Trinh | 439/661 |
| 8,494,330 | B2 * | 7/2013 | Krampotich | G02B 6/4452 385/135 |
| 9,060,427 | B2 * | 6/2015 | Binner | H05K 5/0247 |
| 2002/0072266 | A1 | 6/2002 | Lange | |
| 2003/0022551 | A1 | 1/2003 | Prost et al. | |
| 2004/0082214 | A1 | 4/2004 | Lafragette et al. | |
| 2006/0245169 | A1 * | 11/2006 | Freimuth et al. | 361/729 |
| 2008/0164130 | A1 | 7/2008 | Adunka et al. | |
| 2010/0120295 | A1 * | 5/2010 | Trinh | H01R 9/2491 439/661 |
| 2010/0146167 | A1 * | 6/2010 | Rasche et al. | 710/100 |
| 2012/0258609 | A1 * | 10/2012 | Warneke | H01R 9/2433 439/43 |

FOREIGN PATENT DOCUMENTS

| | | | |
|---|---|---|---|
| DE | 19506862 | A | 8/1996 |
| DE | 19650989 | A | 6/1998 |
| DE | 19945817 | A1 | 4/2001 |
| DE | 202004000523 | U | 5/2005 |
| DE | 202006006615 | U | 9/2006 |
| DE | 102005027824 | A | 12/2006 |
| DE | 202007004414 | U1 | 5/2007 |
| DE | 102006053352 | B | 4/2008 |
| DE | 102008009986 | | 7/2009 |
| DE | 102008017245 | A | 10/2009 |
| EP | 1124286 | A1 | 10/2003 |
| EP | 1564848 | A1 | 8/2005 |
| EP | 1808933 | B | 4/2011 |

* cited by examiner

X 5:1

ELECTRICAL CONNECTING MODULE

PRIORITY

The present application claims priority under 35 U.S.C. §371 to PCT Application PCT/EP2012/002499, filed on Jun. 13, 2012, which claims priority to German Patent Application No. 10 2011 105 156.6, filed on Jun. 17, 2011, and German Patent Application No. 10 2012 010 391.3, filed on May 29, 2012 the disclosures of which are hereby incorporated by reference in their entireties.

The present invention relates to the field of modular electric connections.

For establishing electric connections for industrial applications, connection modules are used, which provide e.g. screw connections or spring-cage connections. Such connection modules normally comprise a plurality of module elements with line connections, e.g. with screw connections or spring-cage connections for accommodating electric lines, and can be snap-fitted onto a common mounting rail. An example for such a connection module is an analog module with module elements having an overall width of 6.2 mm.

The known connection modules, however, necessitate a removal of the lines from the respective connection of the respective module element for separating the electric connection. This is problematic especially in cases where a plurality of module elements are snap-locked on the mounting rail side by side or arranged one on top of the other. If the connections of the respective module element are arranged one below the other, it will be necessary to release, for the purpose of removing a line from the lower connection, the line located above said lower connection, and this necessitates extra time and effort.

It is therefore the object of the present invention to provide an electrical connection module that can be wired with a reduced amount of time and effort.

This object is achieved by the features of the independent claim. Advantageous further developments are the subject matter of the dependent claims, the description and the enclosed drawings.

The invention is based on the finding that the time and effort required for wiring a connection module can be reduced, when the module elements are held with a module housing by means of a snap connection that can be released by a release device. In this way, the module elements can be removed individually from the module housing for releasing an electric connection without the complication of releasing the electric lines from the module elements. In addition, this allows a particularly efficient wiring of individual module elements, without any necessity of releasing in advance the electric connections of the module elements arranged above or below the individual module element in question.

According to an aspect, the invention relates to an electrical connection module with a module housing comprising a module receptacle with a first electrical connection terminal, a module element with a second electrical connection terminal and with a third electrical connection terminal, the module element being insertable into the module receptacle for electrically connecting the first connection terminal with the second connection terminal and retainable in the module receptacle by means of a releasable snap connection, and with a release device for releasing the snap connection.

The first electrical connection terminal and the second electrical connection terminal are connectable to one another e.g. by means of a plug connection. The first connection terminal may thus comprise connection poles formed as connection pins, whereas the second connection terminal may comprise connection poles formed as connection tulips. The first connection terminal may, however, also comprise connection poles configured as connection tulips, whereas the second connection terminal may comprise connection poles configured as connection pins. The third connection terminal is e.g. used for externally wiring the electrical connection module and comprises connection poles provided for receiving therein electric line ends. The connection poles of the first and second connection terminals may, however, also include a respective spring-loaded contact pin which presses onto a contact metal. The connection poles of the third connection terminal may e.g. be clamping connection poles or screw connection poles. They may, however, also be implemented in IDC technology.

According to an embodiment, the module housing further includes an input-output terminal which is electrically connected to the first connection terminal.

The input-output terminal is, for example, used for electrically connecting the electrical connection module to e.g. a line bus or a line system of a control cabinet.

According to an embodiment, the first connection terminal, the second connection terminal and the third connection terminal respectively has a width of a pole.

The first, the second and the third connection terminal may be configured e.g. for a voltage between 5 V and 230 V. The module element may here have a width of 6.2 mm, so that the electrical connection module may be an analog mini module.

According to an embodiment, the module receptacle is delimited by two side walls. If a plurality of module receptacles is arranged side-by-side, these can be delimited by respectively one side wall. The module receptacle may be provided for the reception of only one module element or for the modular reception of a plurality of module elements, which may be arranged one below the other or one on top of the other. The module receptacle may therefore have a width corresponding to a width of one module element.

According to an embodiment, the first connection terminal and the second connection terminal are electrically connectable by means of an electrical plug connection, in particular a pin-tulip plug connection.

According to an embodiment, the first connection terminal and the second connection terminal respectively include connection poles which are arranged one on top of the other, in particular pin connection poles or tulip connection poles, of a multi-pole electrical connection, in particular a multi-pole electrical plug connection. The connection poles are preferably arranged along a vertical axis precisely one on top of the other, whereby small dimensions of the electrical connection module can be preserved in an advantageous manner.

According to an embodiment, the third connection terminal is electrically connected with the second connection terminal and provided for fixedly or releasably receiving electric lines, in particular for releasable and force-fit receiving electric lines.

The third connection terminal may be connected to the second connection terminal in an electrically permanent fashion via connection lines fixed thereto e.g. by soldering and may have connection poles, which receive therein electric lines, in particular electric line ends, in a force fit manner, e.g. by means of a clamping pole connection or a screw pole connection.

According to an embodiment, the third connection terminal comprises electrical connection poles, in particular clamping connection poles or screw connection poles, which are arranged one below the other, in particular exclusively arranged one below the other. The electrical connection poles may be arranged e.g. along a vertical axis one below the other, whereby small dimensions of the electrical connection module can advantageously be accomplished.

According to an embodiment, the module element includes for each electrical connection pole of the third connection terminal an e.g. cuboid-shaped housing, the cuboid-shaped housings being arranged one below the other and a respective rear corner portion of a cuboid-shaped housing being connected with a front corner portion of a cuboid-shaped housing arranged thereunder. The cuboid-shaped housings may each be arranged in a reception recess of the module receptacle.

According to an embodiment, at least one snapping projection or snapping reception arranged within the module receptacle and at least one snapping reception or snapping projection arranged on the module element are provided for establishing the releasable snap connection.

The snapping projection or snapping receptacle arranged in the module receptacle may e.g. be provided on a wall of the module receptacle, in particular on a side wall, a top wall or a bottom wall. The module element may have arranged thereon the snapping projection or the snapping receptacle e.g. laterally or on a top wall or on a bottom wall of the module element.

According to an embodiment, the release device comprises a pulling element for pulling the module element out of the module receptacle. To this end, the release device can be provided for transmitting e.g. a pulling force to the snap connection or for forcing open the snap connection.

According to an embodiment, the release device comprises a pulling element for pulling the module element out of the module receptacle. The pulling element may, for example, be shaped and arranged such that it projects beyond a plane of the module element defined by the front end thereof, and is thus accessible to a user.

According to an embodiment, the pulling element is releasably connectable with the module element, in particular releasably connectable by means of a further snap connection, or the pulling element is integrally connected with the module element. For establishing the snap connection, the module element may include locking snapping element, e.g. a snapping projection or a snapping receptacle, on the end face, the upper side or the lateral surface thereof. For this, e.g. a lug with a snapping element may be provided. Also the pulling element may be provided, e.g. on a front end thereof, with a snapping element, for example a snapping receptacle or a snapping projection, that is arranged e.g. laterally. When a snap connection is being established, the snapping elements of the pulling element and of the module element engage one another and provide a pulling resistance which is sufficiently high for allowing the module element to be pulled out of the module receptacle. The snap connection may be released e.g. by levering out by means of the pulling element. If the pulling element is integrally connected to the module element, the pulling element may be fixed to the module element e.g. by means of an adhesive, by soldering or by welding. The pulling element may, however, be formed integrally with the module element.

According to an embodiment, the pulling element includes a pulling web and a pulling lug, the pulling web being connected or connectable with the module element, in particular at the front end thereof or at the side thereof, and the pulling lug being connected with the pulling web. The pulling lug advantageously allows easy gripping of the pulling web to pull the module element out of the module receptacle.

The pulling element may be used as a lettering surface. In addition, the pulling element may be adapted to be fixed to the module housing or the module element, e.g. rotated by 90°, when it is not in use. Thus, the user can grip it at any time.

According to an embodiment, the pulling element is arranged laterally on the module element and forms an extension of a side wall of the module receptacle or an extension of a side wall of the module element. To this end, the pulling element may have the shape of a flat tongue, which protrudes laterally and which can be gripped.

According to an embodiment, the pulling element cooperates in a form-fit manner with a front end of a side wall of the module receptacle. The form-fit connection e.g. allows easy reinstalling of the connection module into the module receptacle and accordingly a defined housing of the module element in the module receptacle.

According to an embodiment, the release device includes an ejection lever, which is rotatably supported, in particular rotatably spring mounted, and which, for releasing the snap connection, is pressable against the module housing or against the module element. The ejection lever may be arranged e.g. laterally on the module element and pressable against the module housing, for example against a wall of the module receptacle, whereby a force is applied to the snap connection. The ejection lever may, however, be arranged on the module housing and act e.g. on a projection of the module element for releasing the snap connection upon operation.

According to an embodiment, the rotatably supported ejection lever is rotatably supported on the module housing and comprises an ejection rocker with an ejection arm, which is pressable against the module element. Alternatively, the rotatably supported ejection lever is rotatably supported on the module element and comprises an ejection rocker with an ejection arm, which is pressable against the module housing. The ejection rocker may be rotatably spring mounted, e.g. on one end of the ejection arm, so that, upon a deflection out of a position of rest, the ejection arm is pressable against the module element or the module housing, in particular against a wall of the module receptacle. The ejection arm may have the shape of a closed frame with a straight pressing portion adjoining laterally on a curved frame portion. The ejection rocker may, however, have two ejection arms and may be rotatably supported at the center thereof. The first ejection arm serves here to release the connection and the second ejection arm serves to operate the ejection rocker so as to cause the ejection arm, which releases the snap connection, to execute e.g. a rotational movement.

According to an embodiment, a slider for operating the ejection rocker is arranged on the module housing. The slider may e.g. be arranged in a channel of the module housing and may be accessible from outside for operating the ejection rocker. To this end, the slider may e.g. include a module receptacle for a pin, which is adapted to be inserted into the channel.

According to an embodiment, the rotatably supported ejection lever is arranged laterally on the module element and includes an ejection arm with a pressing portion, which is adapted to be pressed against the module housing. Alternatively, the rotatably supported ejection lever includes two ejection arms, each arranged laterally on the module element and each including a pressing portion, the pressing portions being adapted to be pressed against the module housing and being interconnected by means of an operating web. The respective pressing portion adjoins a straight lever portion, e.g. in angular relationship therewith, a bearing point for rotatably supporting the ejection lever being arranged in an area between the pressing portion and the lever portion. When the lever portion is operated, the angled pressing portion can thus be caused to execute a rotational movement so as to release the snap connection.

According to a further embodiment, the release device includes a slider displaceably supported on the module element, which, at a first position, is form-fit snapable, in particular rear snapable, with a side wall of the module receptacle for establishing the snap connection and which is displaceable to a second position for releasing the snap connection. The slider is arranged e.g. laterally on the module element and may have a flat shape so as to be displaceable e.g. in a gap between the module element and a wall to the module receptacle.

According to an embodiment, the slider includes an undercut, which is form-fit snapable with the module housing. To this end, the module housing may, for example, have provided thereon a further undercut cooperating with the undercut of the slider in a form-fit manner. The slider can thus be provided for establishing the snap connection.

According to an embodiment, the slider includes a pin receptacle into which a pin is insertable for displacing the slider. The snap connection can thus be released easily in an advantageous manner. The slider may be spring mounted and return to a snapping position upon releasing the snap connection.

According to embodiment, the release device comprises a rotatable pin with a helix, the helix acting on the module element upon a rotation of the pin for releasing the snap connection. The pin may e.g. have a pin head with a slot so that the rotation can be caused by means of a common screwdriver.

According to an embodiment, the module element includes a helix receptacle for interaction action with the helix. Upon a rotation of the pin, the helix can act on the helix receptacle in a force-fit manner, whereby the module element can be pushed out of the module receptacle.

According to an embodiment, the helix is configured to press the module element out of the module receptacle upon a rotation of the pin by a predetermined angle of rotation, in particular by 180°. In the course of this process, e.g. a snap connection can be released.

According to an embodiment, the helix comprises a first helix area having a helix pitch and a second helix area having a helix pitch, the first helix area being arranged above the second helix area. The module element is thus acted upon by a force by means of the helix at two different points along the longitudinal axis of the pin, so that the module element can be pushed out of the module receptacle linearly and without tilting.

According to an embodiment, the helix is at least sectionwise circumferential around a longitudinal axis of the pin. For this, the helix may, at least sectionwise, have the shape of a thread.

According to an embodiment, the helix is configured for screwing-in the pin upon inserting the module element into the module receptacle, in particular into a receptacle of the module receptacle. This is a particularly easy way of fixing the module element.

According to an embodiment, the helix is configured as a helical spring or a helical groove. The helical spring or the helical groove may be formed on or within the pin.

According to an embodiment, the pin is rotatably supported in the module receptacle. The pin can thus be guided when it is being rotated.

According to an embodiment, the module receptacle includes an opening for receiving the pin therein. The pin can thus be guided and centered when it is being rotated.

According to an embodiment, the pin is releasably insertable into the module receptacle. To this end, the pin may e.g. define a unit together with the module element and may be insertable together therewith into the module receptacle. The pin may, however, also be insertable into the module receptacle as a separate element.

According to an embodiment, the module element comprises a first submodule element with a first connection terminal and a second submodule element with a second connection terminal, the pin being arranged between the first submodule element and the second submodule element.

According to an embodiment, the pin is configured to act upon a rotation by means of the helix on the first submodule element and the second submodule element.

According to an embodiment, the module element is pivotable into the module receptacle. The module element can thus be arranged in the module receptacle particularly easily.

According to an embodiment, the module element is releasably attachable to a pivot shaft fixed to the module housing, in particular to a wall of the module receptacle, for pivoting into the module receptacle. The pivot shaft may be realized e.g. by a horizontal piece of wire, wherein the module element may have a grab hook, which can take hold of the piece of wire.

According to an embodiment, the module receptacle may, however, include a hook, whereas the module element includes a straight piece of wire, which can be adapted to cooperate with the grab hook of the module housing. The pivot shaft may be arranged e.g. on a bottom wall or a top wall of the module receptacle.

According to an embodiment, the module element includes an uneven bottom, which cooperates with an uneven bottom of the module receptacle in a form-fit manner. Improved retaining of the module element in the module receptacle is thus additionally achieved.

According to an embodiment, the bottom of the module receptacle and the bottom of the module element are at least sectionwise rounded. The bottoms may here be undercut such that upon pivoting the module element into the module receptacle, they will be guided past one another.

According to an embodiment, on one of the bottoms a snapping projection and on the respective other one of the bottoms a snapping recess for the snap connection are provided. The bottoms can thus be locked reliably.

According to an embodiment, the module receptacle includes a reception channel, wherein the module element includes a guide cylinder, the guide cylinder being insertable into the reception channel, or the module receptacle includes a guide cylinder, the module element including a reception channel, and the guide cylinder being insertable into the reception channel. The reception channel and the guide cylinder, respectively, may have arranged therein connection poles, e.g. connection pins or connection tulips, of the respective connection terminal. The guide cylinders and the reception channels extend e.g. horizontally with respect to a sectional axis through the module housing and accordingly through the module element, thus allowing the module element to be pushed into the module receptacle particularly easily.

According to an embodiment, the guide cylinder is pushable out of the reception channel by means of an ejection lever, the module element including a tapered portion for modular reception of the ejection lever. The ejection lever may e.g. be introduced in and pressed against the tapered portion so as to remove the guide cylinder from the reception channel. By means of the ejection lever, which defines an embodiment of the release device, the snap connection can be released simultaneously.

According to an embodiment, the module element includes at least one guide pin, which extends transversely to a vertical axis of the module element, wherein a reception channel, in particular a guide channel, for module reception of the guide pin is provided in the module receptacle, and wherein the guide channel includes a depression for snapping engagement with the guide pin so as to establish the snap connection. Hence, the depression forms a trap for the guide pin and thus reliably preventing the module element from being pushed out of the module receptacle. According to an embodiment, a plurality of guide pins may be arranged in parallel one below the other.

According to an embodiment, a barrier-free release channel is provided in parallel with the reception channel, the release channel being connected with the reception channel via an opening, the module element being displaceable from the reception channel towards the barrier-free release channel so as to guide the guide pin through the opening into the barrier-free release channel to release the snap connection. For releasing the snap connection, the module element may e.g. be pushed towards the barrier-free release channel so as to guide the guide pin or a plurality of guide pins through the opening or through a plurality of openings, which plurality of openings corresponds to the plurality of guide pins, into the barrier-free release channel. The module element can then be pushed out of the module receptacle.

For guiding the module element from the reception channel into the barrier-free release channel, a force can be applied by means of a tool, if the opening should be smaller than the guide pin to be passed therethrough. The module element can especially be removed without any application of force as soon as it is located in the release channel, since in the release channel the module element removing forces are virtually equal to zero, since e.g. a connection tulip of a plug connection is no longer positioned on a connection pin.

According to an embodiment, the module housing comprises a plurality of module receptacles including each a first electrical connection terminal, a plurality of module elements including each a second electrical connection terminal as well as a third electrical connection terminal, each module element of the plurality of module elements being insertable into precisely one module receptacle for electrically connecting the first connection terminal with the second connection terminal and to be retained within the module receptacle by means of a releasable snap connection, and a release device for releasing the snap connection for each module element of the plurality of module elements.

The above statements apply analogously to each module element of a plurality of module elements, which are adapted to be arranged within the module housing side-by-side and/or one below the other.

According to an embodiment, neighboring module receptacles are separated by a side wall.

According to an embodiment, the module element comprises or defines one of the following elements: a relay, a relay socket, a coupling relay, a multi-pole plug, a rotation speed monitor, a safety module, in particular an emergency stop module or a safety door circuit, a sensor, in particular a safety sensor, a standstill or rotation speed monitor, a contactor, a passive isolator, a temperature transducer, an analog frequency converter, a position transducer, a switching amplifier, a limit switch, through terminals, a system power supply, a system adapter, an overvoltage protector, an isolating amplifier, a current transducer, a safety-integrity-level function.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

Further embodiments are explained in more detail making reference to the drawings enclosed, in which:

FIG. 1A-1D show an electrical connection module according to an embodiment, FIG. 2A, 2B show a snap connection according to an embodiment, FIG. 3A-3C show a release device according to an embodiment, FIG. 4A-4C show an electrical connection module according to an embodiment, FIG. 5A, 5B show an electrical connection module according to an embodiment, FIG. 6 shows a module element according to an embodiment, FIG. 7 shows a module element according to an embodiment, FIG. 8A-8D show an electrical connection module according to an embodiment, FIG. 9A, 9B show an electrical connection module according to an embodiment, FIG. 10A-10H show an electrical connection module according to a further embodiment, and FIG. 11A-11D show an electrical connection module according to an embodiment.

Figure 1A:
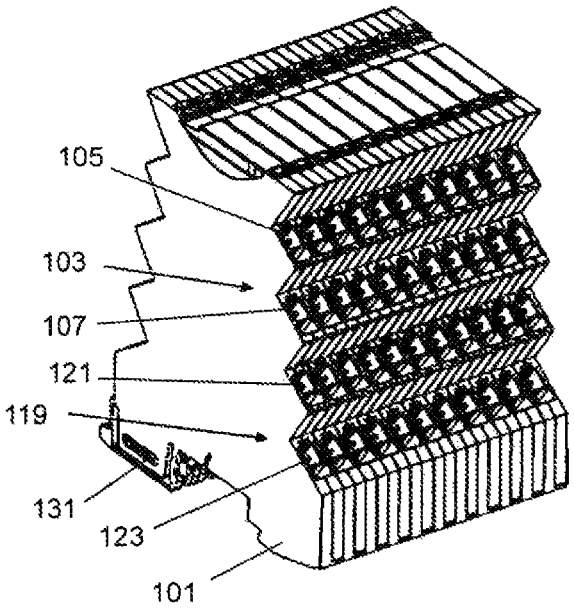

It is to be understood that both the foregoing general description and the following detailed description are exemplary and explanatory only, and are intended to provide an explanation of various embodiments of the present teachings.

FIG. 1A to 1D show an electrical connection module comprising one or a plurality of module housings 101, which may be arranged side by side. The module housing 101 includes a module receptacle 103 with a first connection terminal 105, 107 for modularly receiving therein a module element 109. The module element 109 includes a second electrical connection terminal 111, 113 as well as a third electrical connection terminal 115, 117. The module element 109 is adapted to be inserted in the module receptacle 103, whereby the second connection terminal 111, 113 can be connected to the first connection terminal 105, 107 of the module housing 101.

The module housing may optionally comprise an additional module receptacle 119 with an additional connection terminal 121, 123 for modularly receiving therein an additional module element.

The module element 109 is preferably insertable into the module receptacle 103, whereby the first connection terminal 105, 107 can be connected with the second connection terminal 111, 113 e.g. by means of a plug connection. The module element 109 is adapted to be retained in the module receptacle 103 preferably by means of a snap connection, a release device 125 being provided for releasing the snap connection. The release device 125 is e.g. integrally connected with the module element 109 and extends laterally thereof. The release device 125 is configured e.g. in the form of a pulling element comprising a pulling web 127 as well as a pulling lug 129. The pulling lug 129 allows the pulling element 125 to be gripped so that, for releasing the snap connection, a pulling force can be applied to the snap connection by a user.

The first connection terminal 105, 107 as well as the second connection terminal 111, 113 may each be configured as plug connections, the first connection terminal 105, 107 being formed e.g. by connection poles 105, 107 configured as connection pins. The second connection terminal 111, 113 may be formed e.g. by connection poles 111, 113 configured as respective connection tulips. The connection poles of the first connection terminal 105, 107 may, however, be configured as connection tulips, and the connection poles of the second connection terminal 111, 113 may also be configured as connection pins. The third connection terminal 115, 117 comprises connection poles 115, 117 provided for receiving therein electric line ends. The connection poles 115, 117 are e.g. clamping connection poles or screw connection poles. The connection poles 105, 107, 111, 113 may, however, be arbitrary connection poles which are capable of establishing an electric connection.

As shown in FIG. 1A, the connection poles 105, 107, 111, 113 of the respective connection terminal are arranged one below the other in a row. The module housing can thus be provided with a flat structural design.

The pulling web 127 may be provided e.g. laterally on the module element 109 and extend e.g. a lateral wall of the same.

The module housing 101 additionally comprises an input/output terminal 131 for electric communication with the electrical connection module.

Figure 1B:
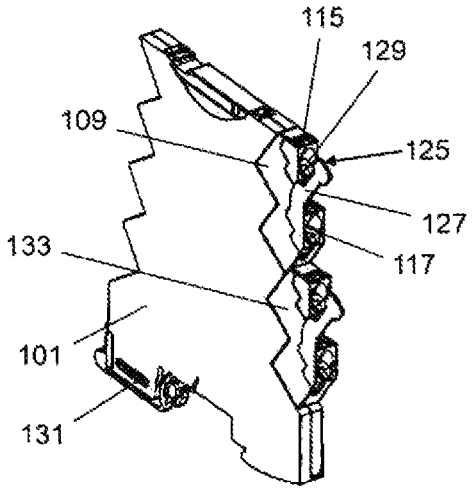

FIG. 1B shows the module housing 101 with the module element 109 arranged in the module receptacle 103 as well as with an additional module element 133 arranged in the module receptacle 119. The structural design of the additional module element 133 is e.g. identical to that of the module element 109.

Figure 1C:
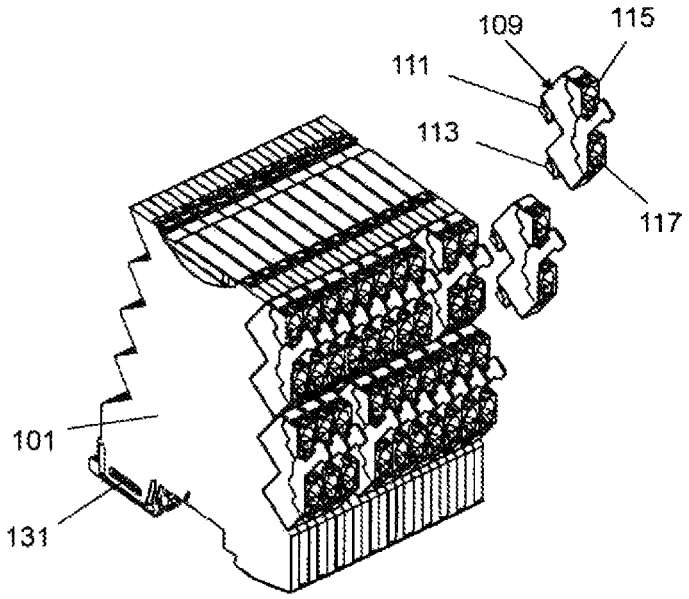
Figure 1D:
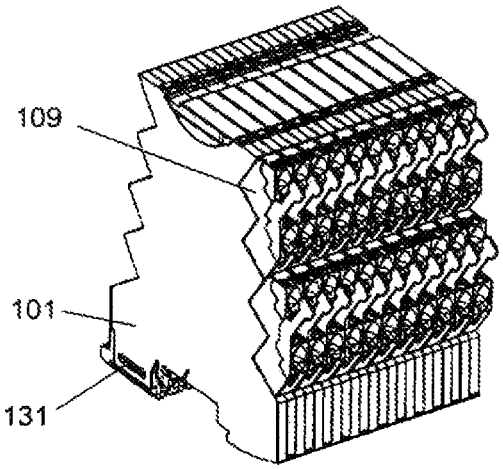

FIGS. 1C and 1D show further views of the electrical connection module with a plurality of module housings 101. As illustrated in FIG. 1C, the module elements 109, 133 can be removed individually from the respective module housing 101, without the necessity of removing module elements located above or below the module element in question. The electrical connection module can thus be wired more easily.

The module housing 101 shown in FIG. 1A can be adapted to be equipped with module elements on one side or on both sides thereof, the module elements being here exclusively arrangeable one below the other in a row. Flexible and simple connection discs are thus formed, which, if necessary, can have added thereto additional connection discs.

Figure 2A:
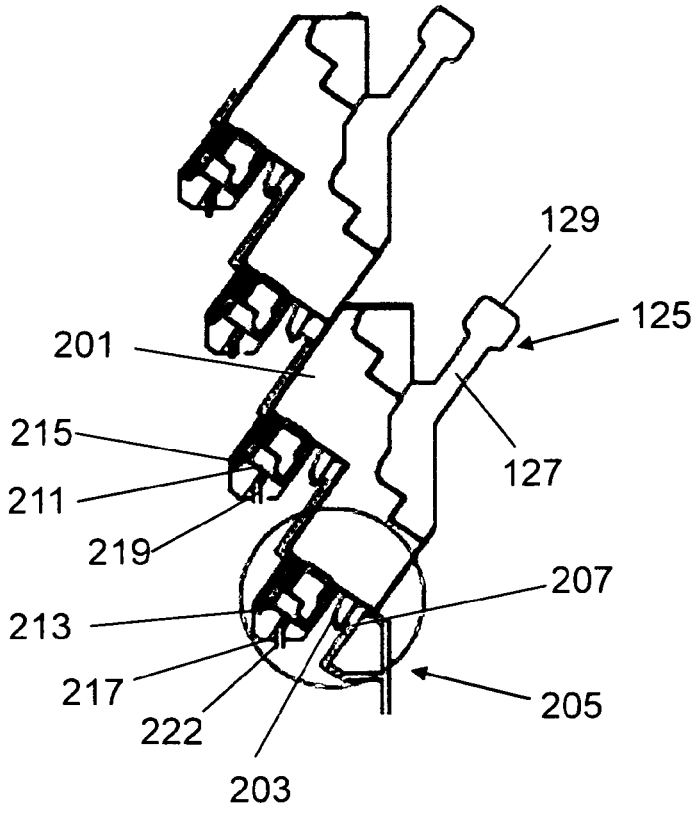
Figure 2B:
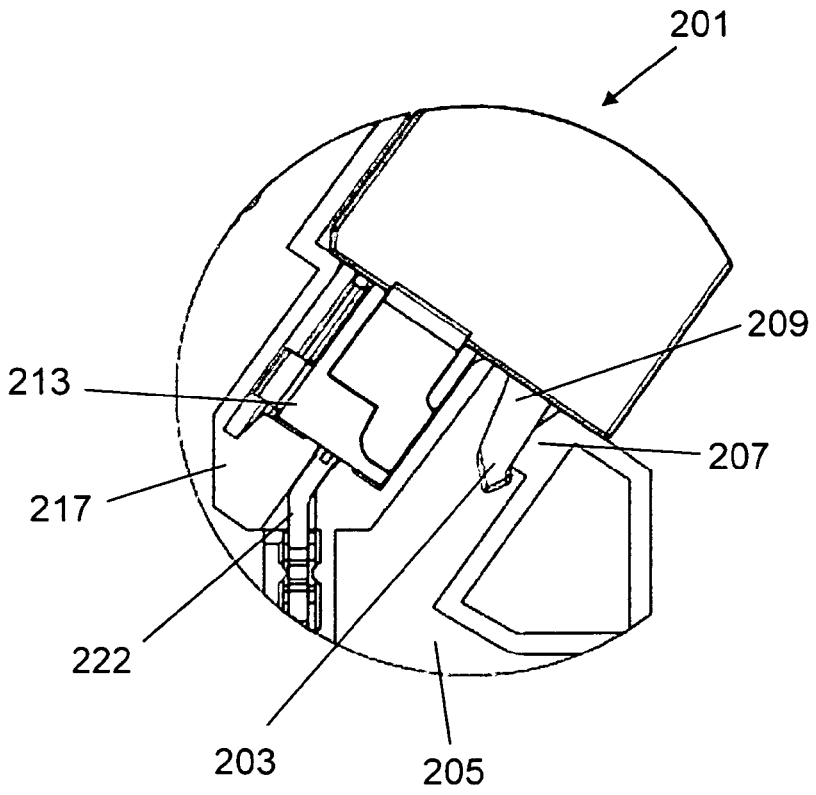

FIGS. 2A and 2B show an embodiment of a snap connection, which can be used for snapping a module element 201. The module element 201 may have a structural design identical to that of the module element 109 shown in FIG. 1A and may comprise e.g. the release device 125 or one of the release devices described hereinbelow. For establishing the snap connection, the module element 201 includes on the lower side thereof a snapping projection 203 cooperating with a snapping receptacle 205, which may be arranged e.g. in the module receptacle 103. The snapping receptacle 205 may e.g. include a snapping projection 207 and may e.g. be formed elastic. Upon inserting the module element 201 into the module receptacle, the snapping projection 203 slides along a bevel 209 of the snapping projection 207 and snaps in position therebehind, whereby the snap connection is established. For releasing the snap connection, the snapping projection 207 may e.g. be pushed back. For this purpose, the snapping projection 207 may be provided with a rear bevel, along which the snapping projection 203 can slide for releasing the snap connection.

As shown in FIG. 2A, 2B, the connection module 201 comprises a connection terminal 211, 213 with connection poles, which are insertable into connection recesses 215, 217 defining a module receptacle. The connection recesses 215, 217 have formed therein the first connection terminal 219, 222 with connection poles configured e.g. as connection pins or connection tulips.

Figure 3A:
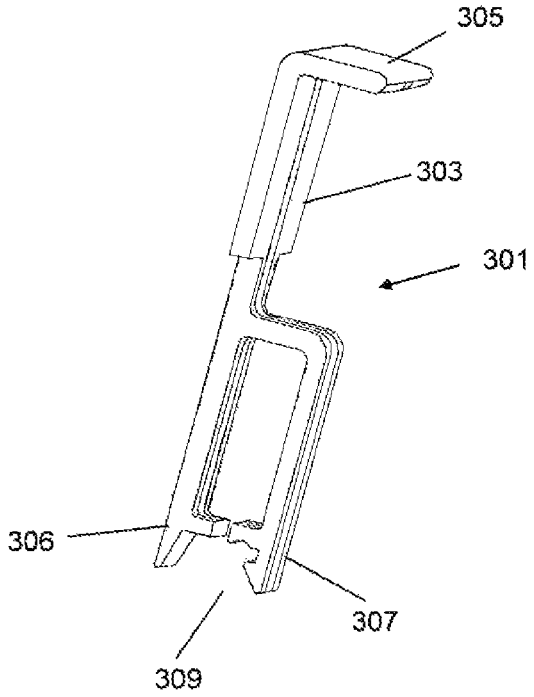
Figure 3B:
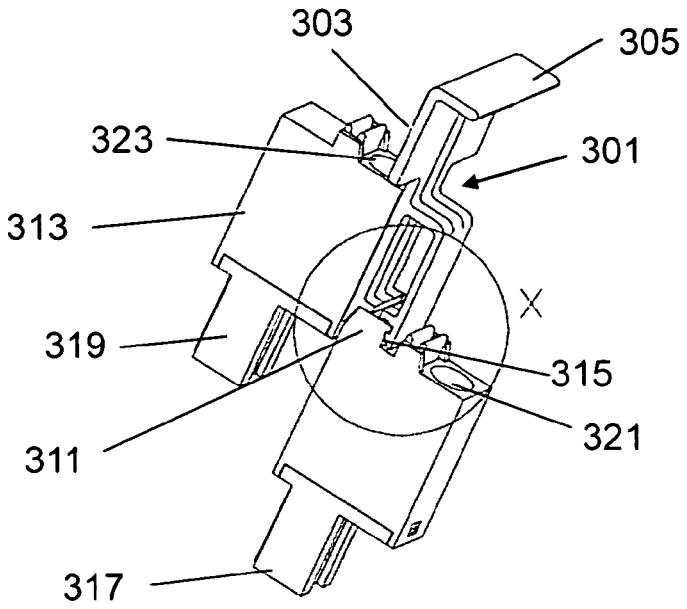
Figure 3C:
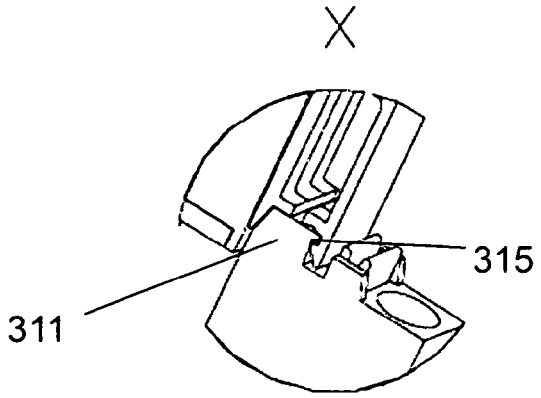

FIG. 3A to 3C show a release device 301 according to an embodiment. The release device 301 comprises a pulling web 303 as well as a pulling lug 305, which may have an angled portion 307. The pulling lug 305 may also be used as a lettering surface. The pulling web 303 is formed e.g. by a frame, which is separated at its end so that the frame ends 306, 307 define a flexible snapping element 309. The snapping element 309 may cooperate e.g. with a snapping element 311 of the module element 313 shown in FIG. 3B, so as to establish a snap connection. To this end, the snapping element 311 includes e.g. lateral guide lugs 315 defining a reception space for the snapping element 309. The reception space may have arranged therein e.g. a snapping projection cooperating with the snapping element 309 for establishing the snap connection. The detail enclosed by the circle is shown in an enlarged representation in FIG. 3C. Since the release device 301, which defines a pulling element, is releasably connectable with the module element 313, the arrangement of module housings shown e.g. in FIG. 1A can be equipped in a particularly easy manner making use of the module element 313 shown in FIG. 3B.

The module element 313 may e.g. include a second connection terminal 317, 319 and a third connection terminal 321, 323 having the features of the first and second connection terminals described hereinbelow.

Figures 4A, 4B:
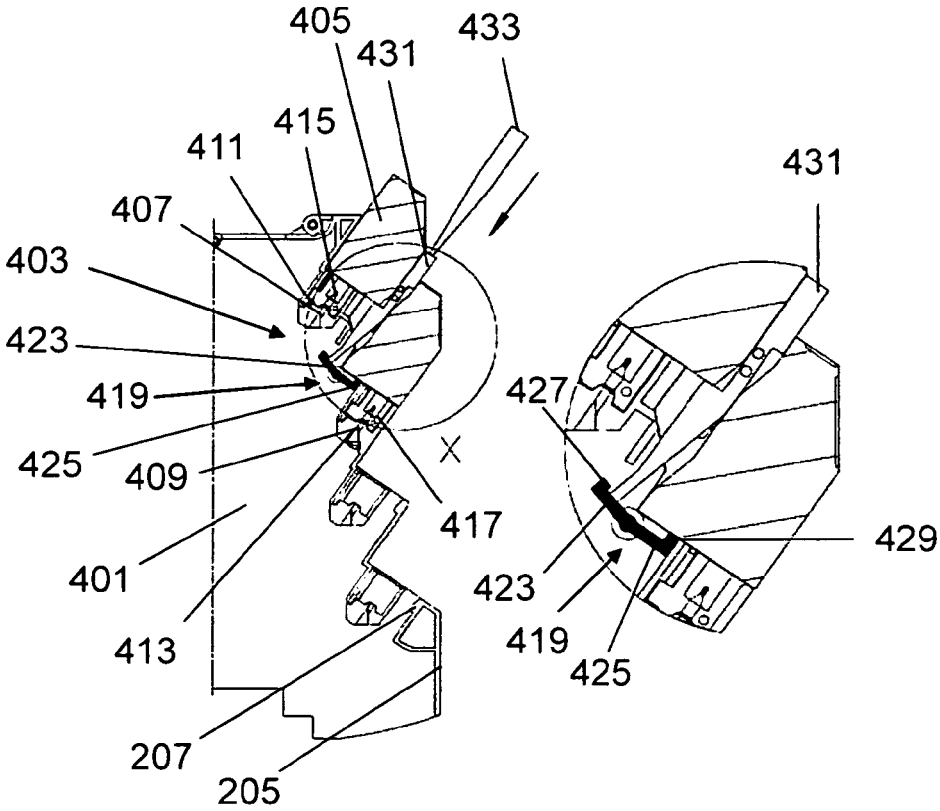

FIG. 4A to 4B show an electrical connection module according to a further embodiment. The electrical connection module comprises a module housing 401 with a module receptacle 403 into which a module element 405 can be inserted. The module receptacle 403 comprises a first connection terminal 407, 409 with connection poles 407, 409, the respective connection poles 407, 409 being arranged in the reception recesses 411, 413 of the module housing 401 and provided for receiving therein a second connection terminal 415, 417 with connection poles 415, 417 of the module element 405. The respective connection poles 407, 409, 415, 417 may be connected with one another e.g. by means of a plug connection. The module element 405 is adapted to be retained in the module receptacle 403 e.g. by means of a snap connection of the type shown in FIG. 2B.

Figure 4C:
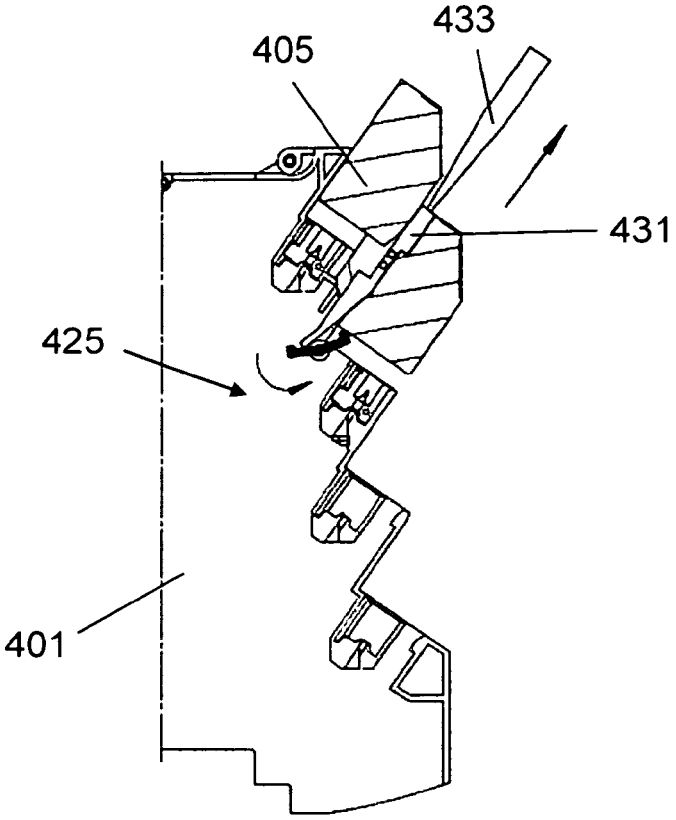

For releasing the snap connection, a release device 419 is provided, which includes a rotatably supported ejection lever 421. The ejection lever 421 comprises a first ejection arm 423 and a second ejection arm 425 and forms thus a rotatably supported ejection rocker for releasing the snap connection. For this, the ejection arms 423, 425 each include a pressing portion 427, 429. For operating the ejection rocker, a slider 431 is provided, which, when operated, acts on the first ejection arm 423. The ejection rocker is thus caused to execute a rotational movement. This has the effect that the pressing portion 429 of the second ejection arm 425 presses against the module element, whereby the snap connection can be released. The slider 431 may be configured as a multi-part component including e.g. one or a plurality of joints, and is adapted to be operated from outside e.g. by means of a tip 433, whereby the module element 405 can be released, as shown in FIG. 4C.

Figure 5A:
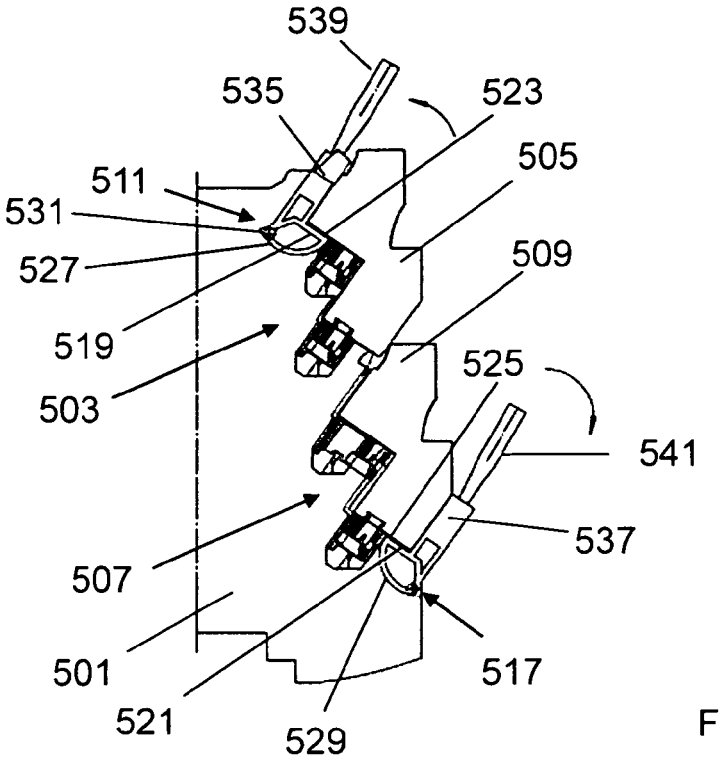
Figure 5B:
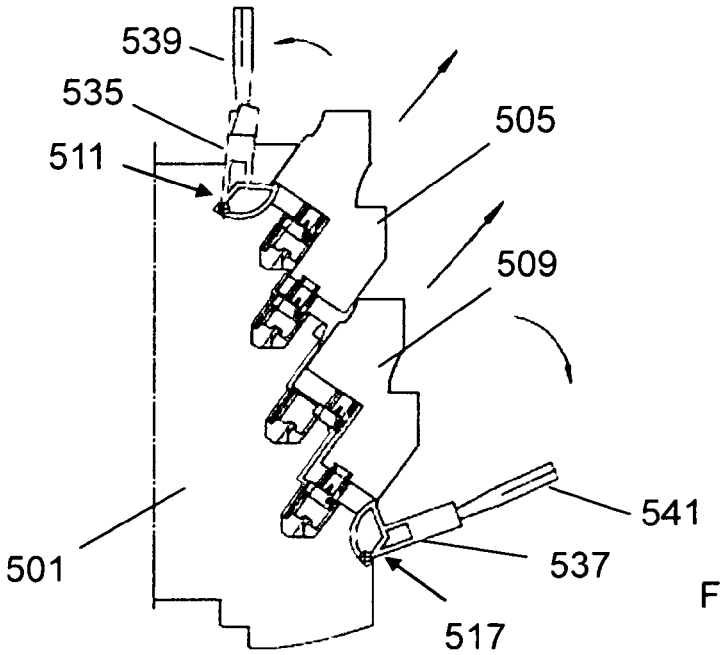

FIGS. 5A and 5B show an electrical connection module according to a further embodiment. The electrical connection module comprises a module housing 501 with a first module receptacle 503 into which a module element 505 can be inserted, and with a second module receptacle 507 into which an additional module element 509 can be inserted. The module receptacles 503, 507 as well as the module elements 507, 509 include second connection terminals having the features described above and below. The module elements 505 and 509 are adapted to be retained in the module receptacles 503, 507 by means of a respective snap connection. For releasing the respective snap connection, release devices 511, 517 are provided, which each include an ejection arm 519, 521. The ejection arms 519, 521 each include a pressing portion 523, 525 and are each configured in the form of a frame with curved frame portions 527, 529. The ejection arms 519, 521 are each laterally supported on a bearing point 531 and define respective operable ejection rockers, which can each be operated by means of a slider 535, 537 such that they execute a rotational movement for releasing the respective module element 505, 509. For operating the ejection rockers, e.g. ejection tips 539, 541, which can be inserted from outside, may be used.

As indicated in FIG. 5A, the ejection rockers are rotatable in opposite directions of rotation, so that the module elements 505, 509 can be released independently of one another, as shown in FIG. 5B.

Figure 6:
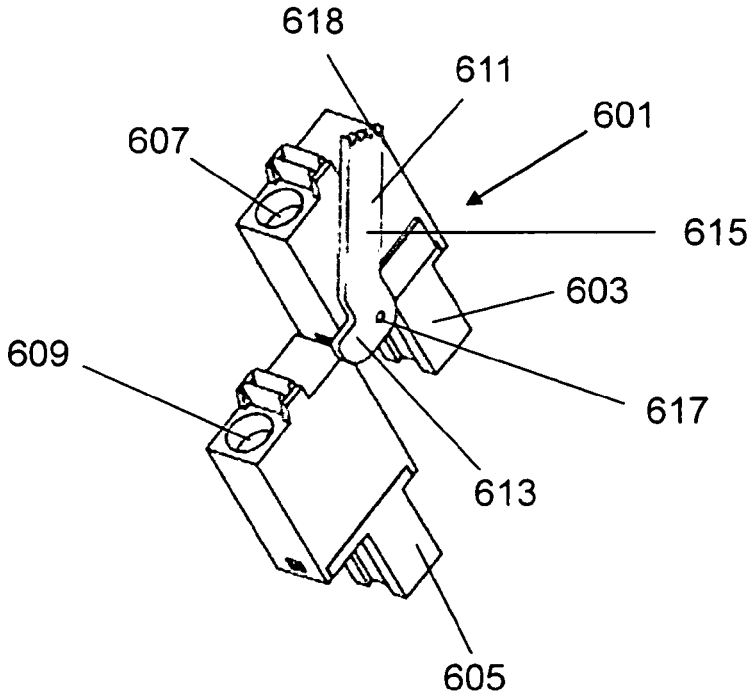

FIG. 6 shows a module element 601 with a second connection terminal 603, 605 and with a third connection terminal 607, 609. The second connection terminal 603, 605 as well as the third connection terminal 607, 609 may e.g. have the above and below described features of the second and third connection terminals. The module element shown in FIG. 6 is adapted to be inserted e.g. in a module housing, which is not shown in FIG. 6, and to be retained therein by means of a snap connection. For releasing the snap connection, a release device 611 is provided, which comprises an ejection lever with a pressing portion 613 and a lever portion 615. The release device is rotatably supported on a center of rotation 617, so that, upon operating the lever portion 615, the pressing portion 613 can be pressed against the module housing, in particular against a side wall of a module receptacle of the module housing, whereby the snap connection can be released and the module element 601 removed from the module housing. The lever portion 615 may have on its accessible end e.g. notches 618, which allow the ejection lever to be easily operated. As shown in FIG. 6, the pressing portion 613 is angularly connected with the lever portion 615, whereby an angled lever is defined.

Figure 7:
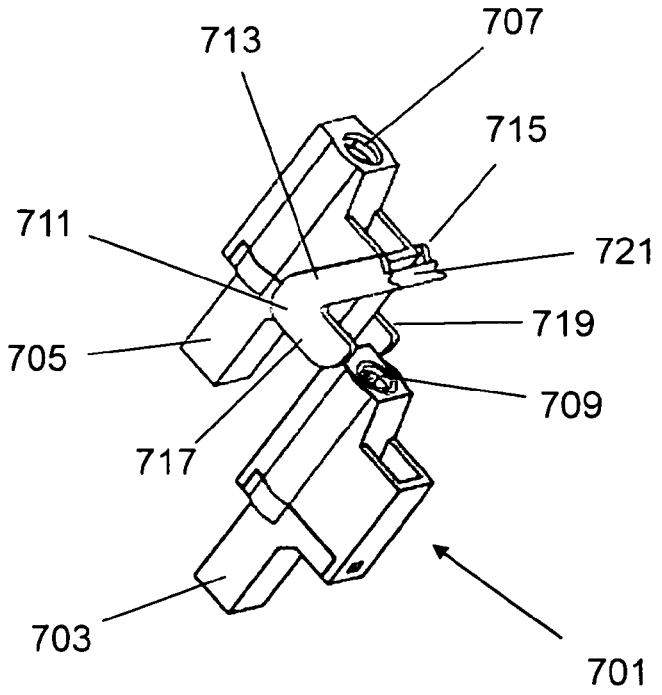

FIG. 7 shows a module element 701 according to a further embodiment. The module element 701 comprises a second connection terminal 703, 705 as well as a third connection terminal 707, 709. The second connection terminal 703, 705 and the third connection terminal 707, 709 have features of the type described exemplarily hereinbelow with respect to the second and third connection terminals. The module element 701 is e.g. adapted to be retained in a module housing by means of a snap connection. For releasing the snap connection, a release device 711 is provided, which is defined by respective ejection arms each rotatably arranged at respective sides of the module element 701. The ejection arms each comprise a lever portion 713, 715 as well as a pressing portion 717, 719. The lever portions 713, 715 are interconnected by means of an operating web 721 and are operable in common for releasing the snap connection. In the course of this process, the release device 711 is caused to execute a rotational movement, so that the pressing portions 717, 719, which are angularly connected with the lever portions 713, 715, are pressed e.g. against the module housing, whereby the snap connection can be released.

FIG. 8A to 8D discloses an electrical connection module comprising a module housing 801, which is adapted to be equipped with module elements e.g. on one side or on both sides thereof. To this end, the module housing 801 comprises module receptacles 803, 817 into which module elements 805, 807 can be inserted and retained by means of a respective snap connection.

For releasing the respective snap connection, a respective release device 809, 811 is provided, each of the release devices including a slider 813, 815. The sliders 813, 815 are, e.g. at a first sliding position, snapable with a wall of a respective module receptacle 803, 817 in a form-fit manner, e.g. rear snapable. For releasing the snap connection, the sliders are e.g. displaceable to a second position.

For form-fit rear snapping engagement the sliders 813, 815 comprise a respective undercut 819, 821 cooperating with an undercut 823, 825 in the respective module receptacle 803, 817.

The sliders 813, 815 may be provided with slide lugs 808, which are arranged e.g. on one side or on both sides on the respective module element 805, 807 and which may be connected by webs 810, the slide lugs being provided with respective guide openings 826, 827 receiving therein guide projections of the respective module element 805, 807 for movement therealong. If the slide lugs are arranged on either side of the respective module element 805, 807, they may be connected with one another by means of a connection web on the respective front and rear sides.

For releasing the snap connection, the sliders 813, 815 comprise respective pin receptacles 829, 831, each adapted to have a pin 873 inserted therein for pushing the respective slider 813, 815 to the first or to the second position. According to an embodiment, the sliders 813, 815 may be spring mounted and automatically return to a first sliding position so as to allow rear snapping engagement.

The module elements 805, 807 are e.g. adapted to be pivoted into the module receptacles. For this, a respective wall of the module receptacle in question may have provided thereon pivot shafts 835, 837 to which the module elements 805, 807 can releasably be attached. Optionally, the module elements 805, 807 may each include connection pole-related rounded bottoms 839 which can cooperate with rounded bottoms 841 of the module receptacles in a form-fit manner. The module elements 805, 807 can thus be pivoted into the respective module receptacle particularly easily.

The embodiments shown in FIG. 8A to 8D apply analogously also to cases in which the module housing 801 has a single module receptacle for accommodating a single module element.

Figure 8A:
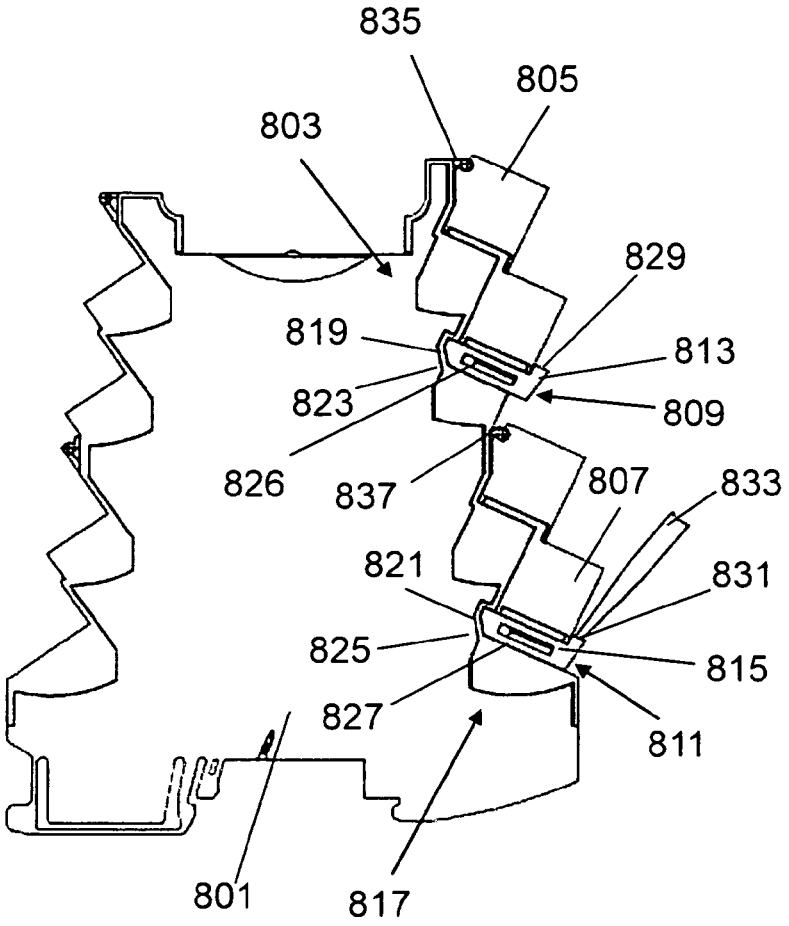
Figure 8B:
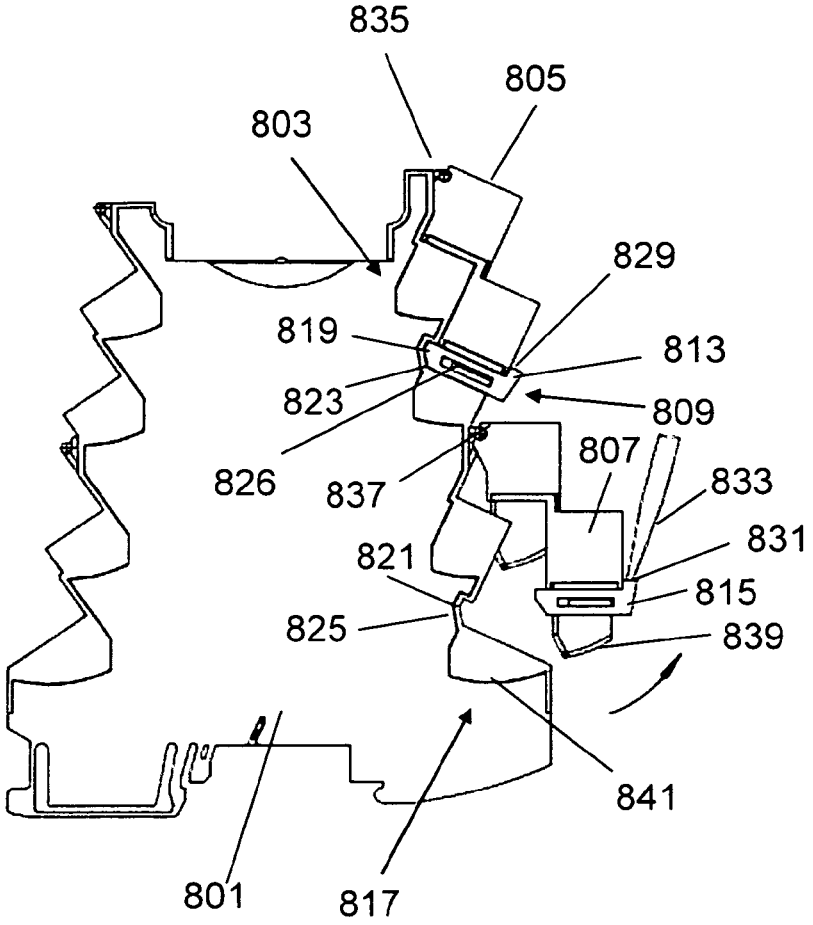
Figure 8C:
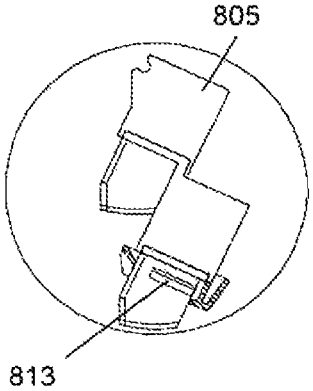
Figure 8D:
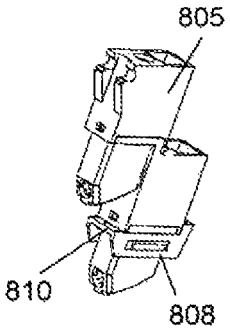

The module elements 805, 807 shown in FIG. 8A to 8D may be retainable by means of additional snapping elements. As shown in FIG. 8C, the slider 813, 815 may also be cut.

Figure 9A:
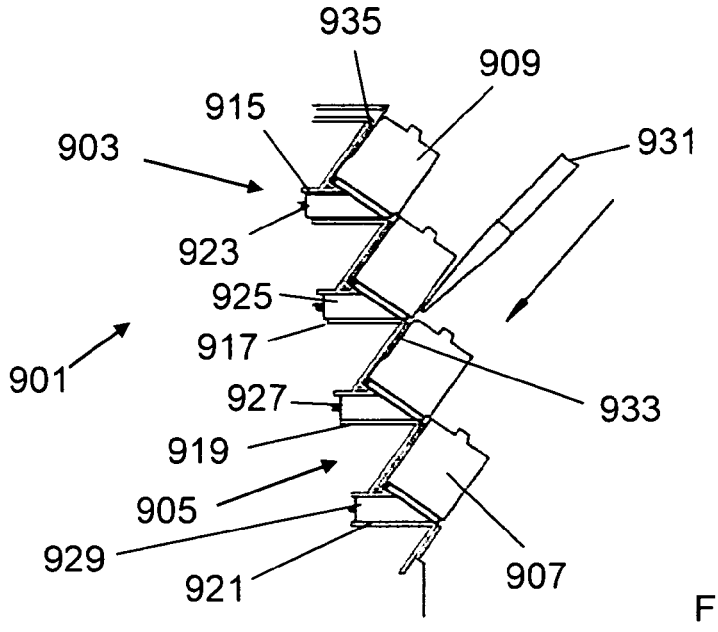
Figure 9B:
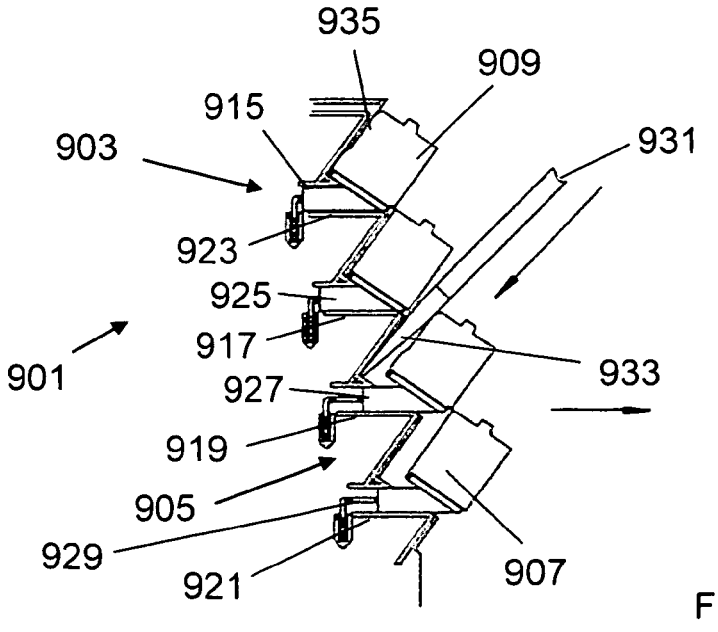

FIGS. 9A and 9B show an electrical connection module according to an embodiment. The electrical connection module comprises a module housing 901 with module receptacles 903, 905, into which module elements 907, 909 can be inserted. The module receptacles 903, 905 have reception channels 915, 917, 919, 921 provided therein. The module elements 907, 909 comprise guide cylinders 923, 925, 927 929, which are adapted to be inserted into the reception channels 915-921. The reception channels 915-921 may have arranged therein connection poles of the electrical connection terminal of the module housing 901. The guide cylinders 923-929 may have arranged therein connection poles of the connection terminal of the module elements.

The module elements 907, 909 are retainable in the module receptacles 903, 905 e.g. by means of a respective snap connection. For pushing the guide cylinders 923-929 out of the reception channels 915-921 as well as for releasing the respective snap connection, an ejection lever 931, which may have the shape of an ejection tip, may be inserted into a tapering portion 933, 935 of the respective module element 907, 909. The module elements 907, 909 can thus be pushed out horizontally, as illustrated in the figures.

FIG. 10A-10H show an electrical connection module according to a further embodiment. The electrical connection module comprises a module housing 1001 with module receptacles 1003, 1005, each provided for receiving therein a module element 1007. The module receptacles 1003, 1005 comprise respective connection terminals 1009, 1011, 1013, 1015, which are arranged in reception recesses 1017, 1019, 1021, 1023. The module element 1007 comprises a connection terminal having the features described above and below.

The module receptacles 1017-1023 have provided therein reception channels 1025, 1027, which are stepped towards the respective module receptacle. A release channel 1027, which is barrier free, is provided in parallel with the respective reception channel 1025. The reception channels 1025 and 1027 have openings formed between them, through which the reception channels 1025 and 1027 communicate with one another.

Figure 10A:
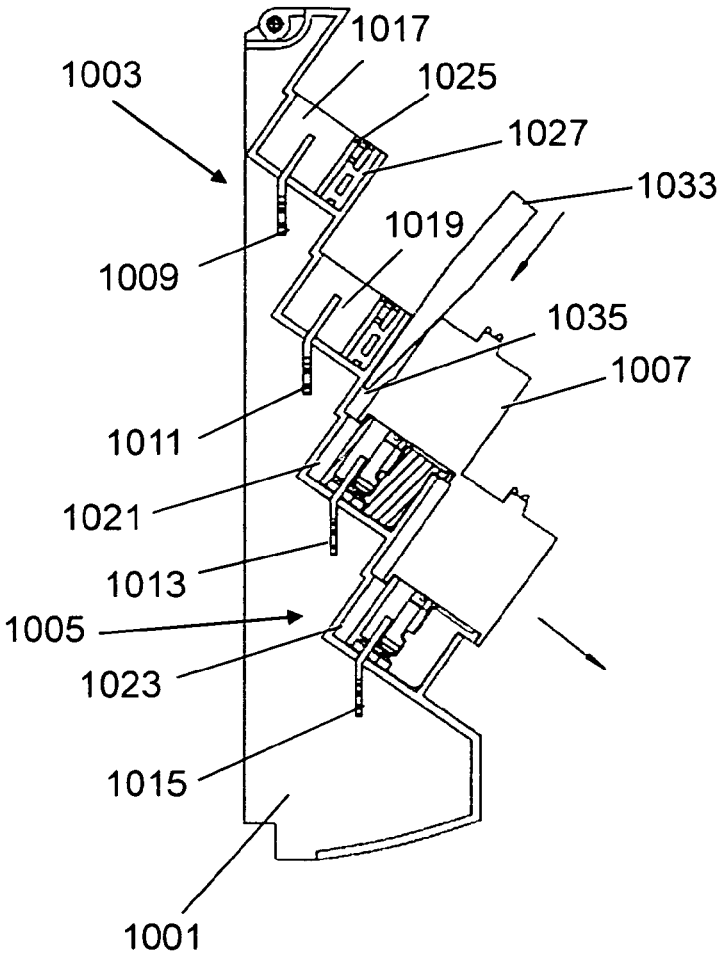
Figure 10B:
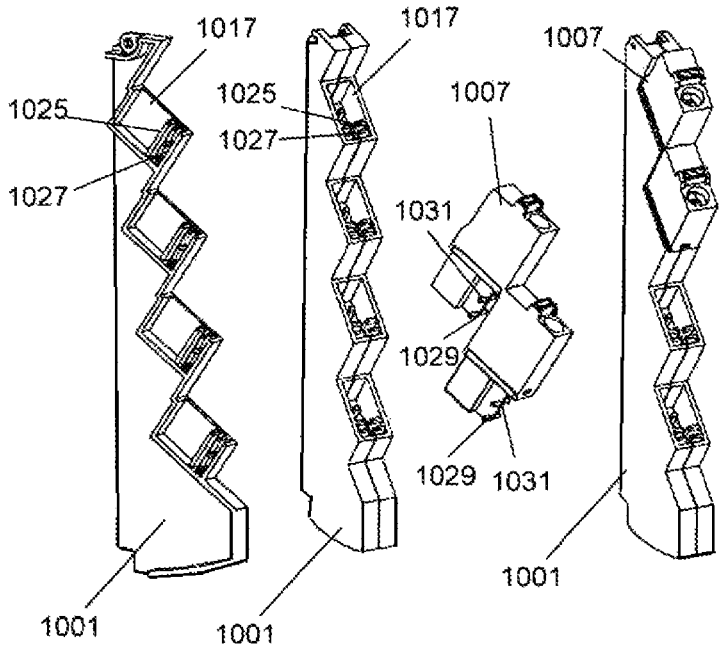
Figures 10C, 10D, 10E, 10F:
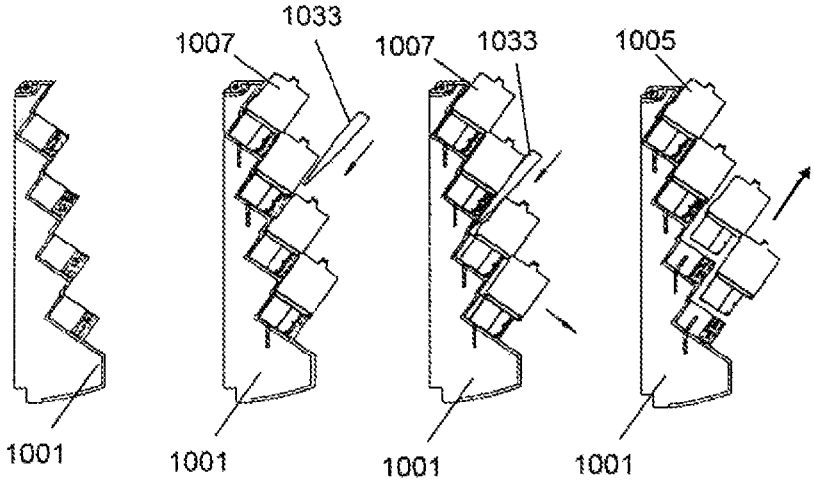
Figure 10G:
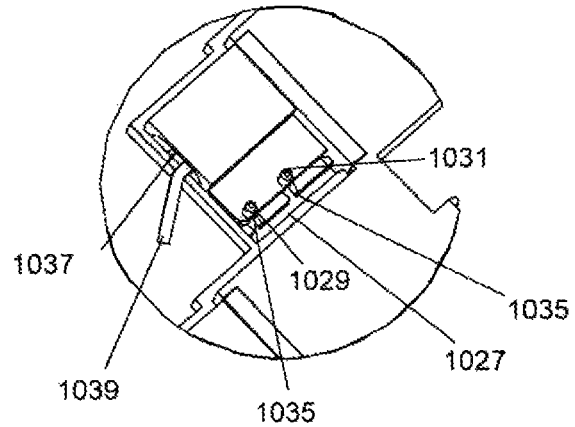
Figure 10H:
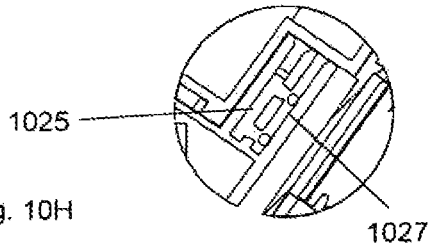
Figure 11A:
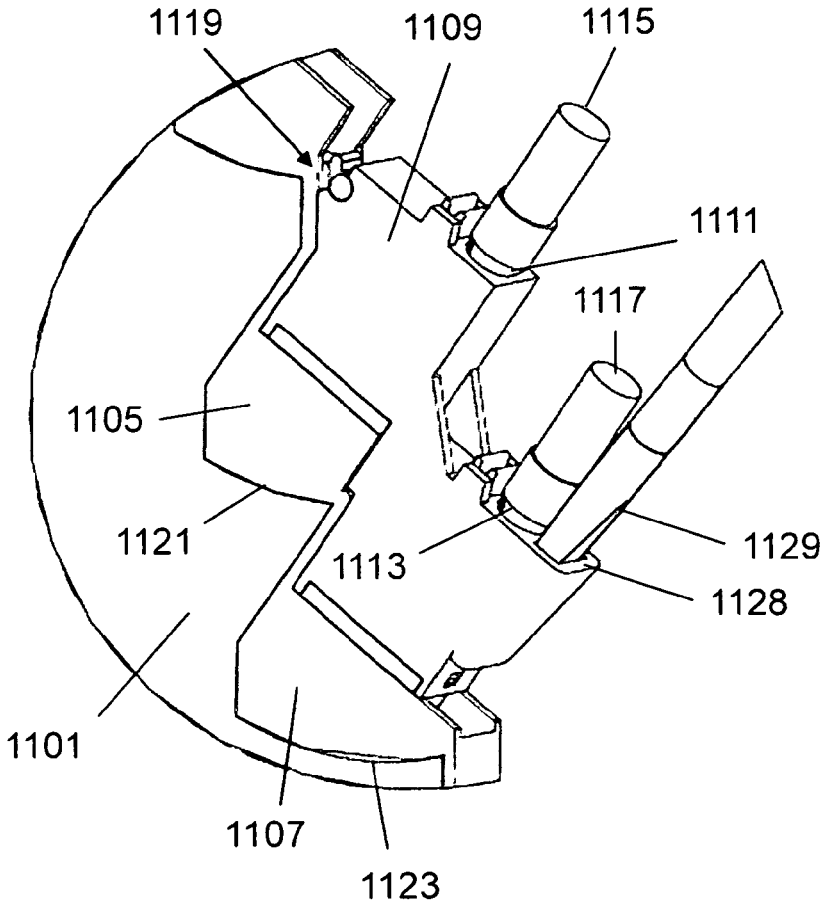
Figures 11B, 11C:
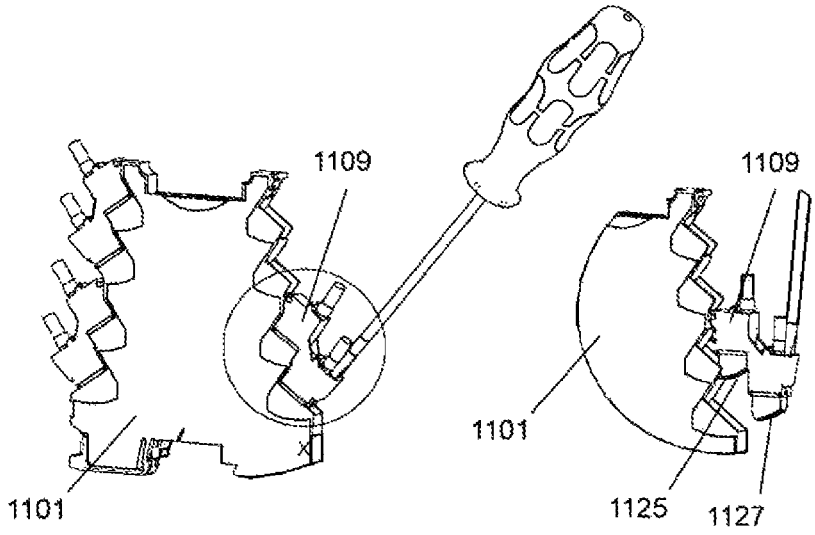
Figure 11D:
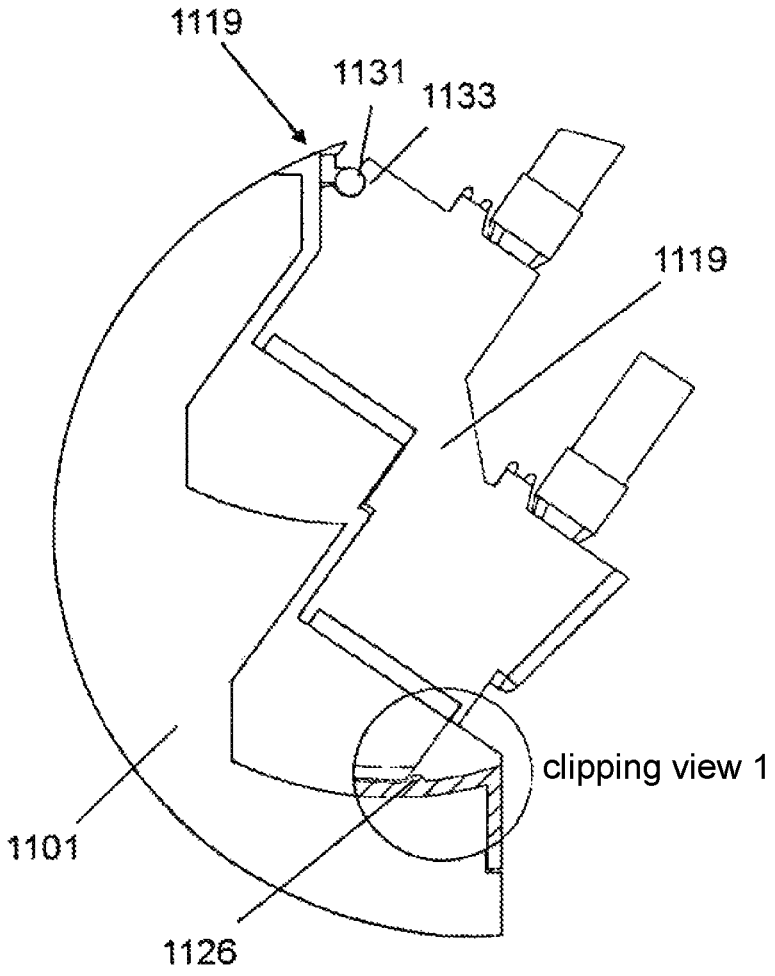

The module element 1005 comprises a third connection terminal having the features described above and below. In addition, the module element 1007 comprises guide cylinders 1029, 1031, which are adapted to be inserted into the reception channel 1025 e.g. upon inserting the module element 1007 into the module receptacle 1003. The stepped portion of the reception channel 1025 is configured e.g. as a depression and defines a trap for the guide cylinders 1029, 1031, whereby a snap connection can be realized. For releasing the snap connection, the module element 1007 can be displaced by means of a guide pin 1033, which is adapted to be inserted into a tapered portion 1035 of the module element 1007, such that the guide cylinders 1029, 1031 will pass through the tapered portions out of the reception channel 1025 and into the release channel 1027 and can be pushed out of the release channel 1027 for removing the module element 1007, as shown in FIG. 10D-10F. To this end, the second connection terminal of the module element 1005 may, as shown in FIG. 10G, be provided with an elongated hole 1037, in which a connection pin 1039 of the connection terminal of the module housing 1001 is arranged. The elongated hole 1037 allows the module element 1007 to be displaced so as to release the snap connection.

Subsequently, the module element 1007 can be removed e.g. manually.

The module housing 1001 shown in FIG. 10A may be provided for accommodating a single module element 1007 or a plurality of module elements 1007 one below the other. The module housing 1001 as well as the module element may have features of the above and below-described module housings and module elements.

FIG. 11A to 11D shows an electrical connection module according to an embodiment. The electrical connection module comprises a module housing 1101 with a module receptacle 1103 including reception recesses 1105, 1107 for receiving therein a connection terminal of a connection module 1109. The module element 1109 comprises a third connection terminal 1111, 1113 with connection poles, which are adapted to have inserted therein line ends 1115, 1117.

The module element 1109 is e.g. adapted to be pivoted into the module receptacle 1103. To this end, the module housing 1109 has provided thereon a pivot shaft 1119 to which the module element 1109 can be attached e.g. at the end face thereof. A rotational movement about the pivot shaft 1119 can thus be executed and the module element 1109 can be guided newly into the module receptacle 1103. The reception recesses 1105, 1107 may, for this purpose, optionally be provided with rounded bottoms 1121, 1123 that are able to receive in a form-fit manner the shape of bottoms 1125, 1127 of the module element 1109, which are rounded as well. The module element 1109 is preferably adapted to be snapped in position in the module receptacle 1103. To this end, the respective bottom 1121, 1123 of the reception recess 1105, 1107 in question may have a snapping projection 1126, which is exemplarily shown in FIG. 11D.

For releasing the snap connection, the module element 1109 may have provided thereon a receptacle into which a pin 1129 can be inserted for pivoting the module element 1109 out of the module receptacle 1103 so as to release the snap connection.

Upon pivoting the module element 1109 into the module receptacle 1103 and upon pivoting the module element 1109 out of the module receptacle 1103, it is rotated about the pivot shaft 1119. The pivot shaft 1119 may include e.g. a piece of wire 1131, which is adapted to be inserted into an opening 1133 of the module element 1109, whereby the module element 1109 can be attached and pivoted about the pivot axis 1119.

Figure 12A:
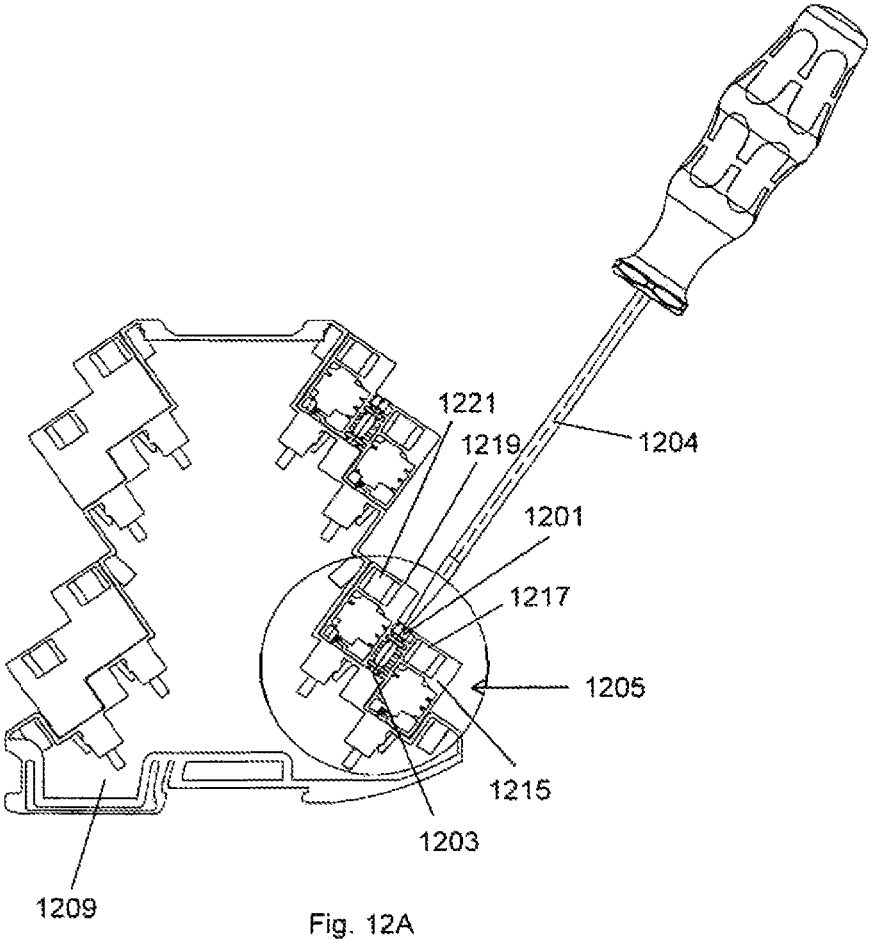
FIG. 12A-12B show an electrical connection module according to an embodiment.
Figure 12B:
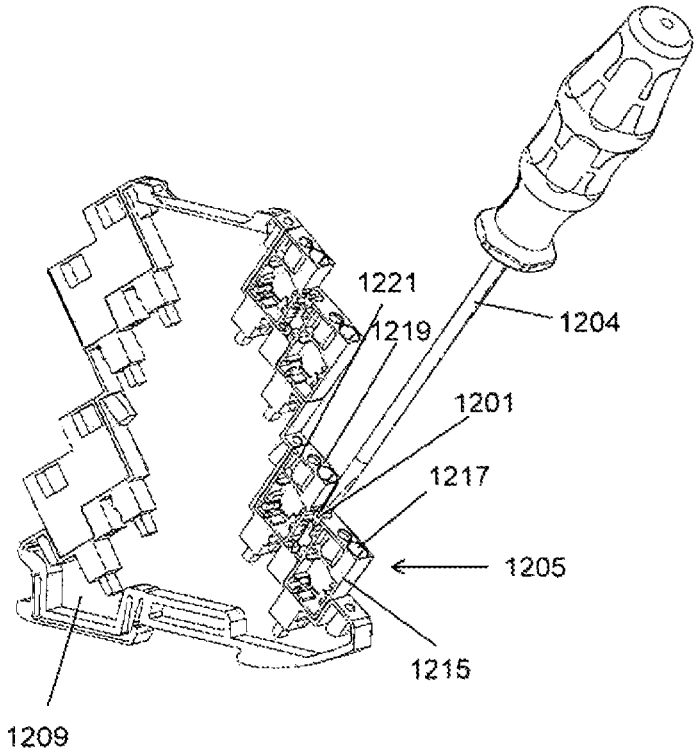

FIGS. 12A and 12B show views of an electric connection module according to an embodiment. The release device comprises a rotatable pin 1201 with a helix 1203 that may be realized by a male thread provided on the pin 1201. Upon a rotation of the pin 1201 about its longitudinal axis, the helix 1203 acts on the module element 1205 for releasing the snap connection. To this end, the module element 1205 may include a helix receptacle, e.g. a web or a female thread. The helix 1203 may, however, be configured as a helical spring or a helical groove. The rotation of the pin 1201 may for example be caused by means of a tool 1204, e.g. a screwdriver.

Due to an interaction between the helix 1203 and the helix receptacle, the module element 1205 is pressed out of the module receptacle 1209, as shown in FIG. 12B.

The module element 1205 comprises, according to an embodiment, a first submodule element 1215 with a first connection terminal 1217 and a second submodule element 1219 with a second connection terminal 1221, the pin 1201 being arranged between the first submodule element 1215 and the second submodule element 1219. The first connection terminal 1217 and the second connection terminal 1221 define a common connection terminal of the module element 1205.

Therefore, the pin 1201 can act simultaneously and force-symmetrically on the first submodule element 1215 and on the second submodule element 1219 during a rotation caused by means of the helix 1203.

For releasing the connection, e.g. a snap connection, between the module element 1205 and the module receptacle, the pin 1201 can be rotated by a predetermined angle of rotation, in particular by 180°. For this, the pin 1201 may be rotatably supported in the module receptacle 1209, e.g. in an opening of the module receptacle 1209.

According to an embodiment, the helix 1203 is configured for automatically turning or screwing the pin 1201 into the module receptacle 1209 upon inserting the module element 1205. To this end, the pin or helix may comprise in the front area of the pin a male thread, which, upon inserting the module element 1205, will screw itself automatically into the module receptacle 1209, i.e. into the basic housing for the module element 1205, due to the thread pitch chosen.

Figure 13A:
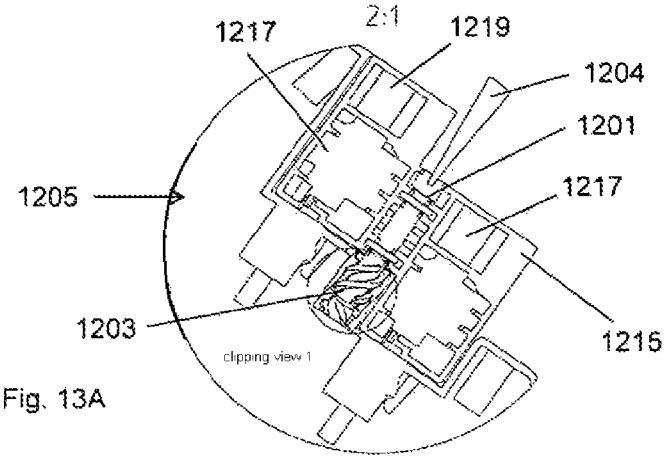
FIG. 13-13C show an electrical connection module according to an embodiment.
Figure 13B:
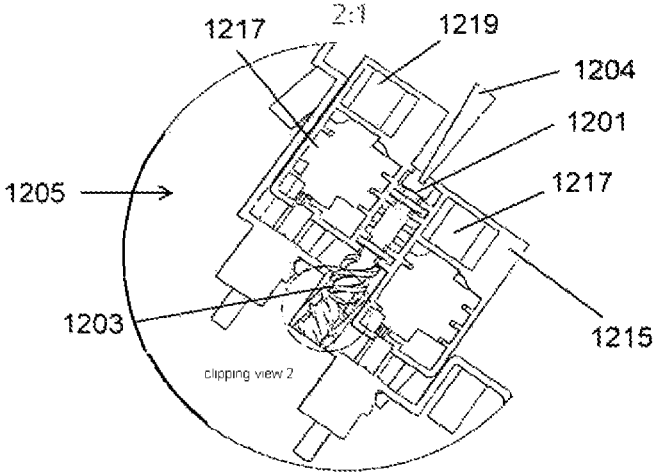
Figure 13C:
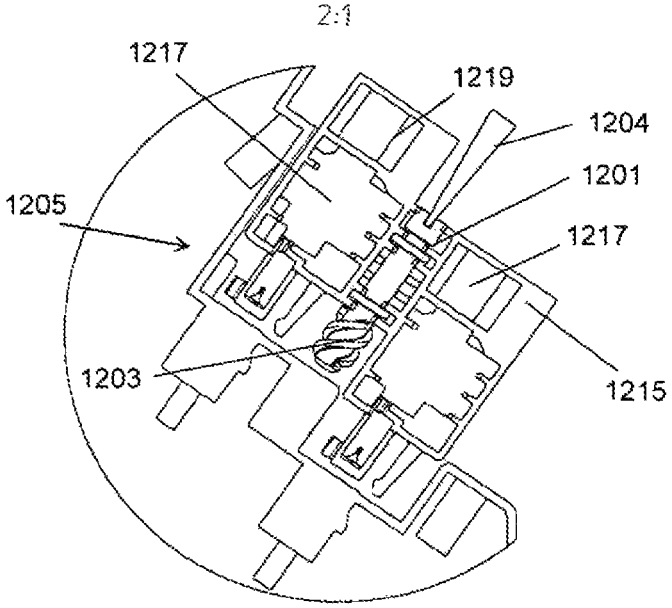

FIGS. 13A, 13B and 13C show views of an electrical connection module according to an embodiment. As shown in FIGS. 13A and 13B, the pin 1201 is unscrewed by means of the tool 1204. This has the effect that the module element 1205 is forced out of the module receptacle. As can be seen in FIG. 13C, the helix 203, e.g. a thread, screws itself out of the module receptacle, so that the module element 1205 can be released and removed particularly easily. For inserting the module element 1205 into the module receptacle, the helix 1203 screws itself into the module receptacle e.g. automatically. A particularly simple fastening of the module element 1205 in the module receptacle is achieved in this way.

According to an embodiment, the electrical connection module shown in FIGS. 12A and 12B may comprise a plurality of module elements 1205 with the above-described features.

LIST OF REFERENCE NUMERALS

101 module housing
103 receptacle
105, 107 connection terminal
109 module element
111, 113 connection terminal
115 connection terminal
117 connection terminal
119 module receptacle
121, 123 connection terminal
125 release device
127 pulling web
129 pulling lug
131 input/output terminal
133 module element
201 module element
203 snapping projection
205 snapping receptacle
207 snapping projection
209 bevel
211, 213 connection terminal
215 connection recess
217 connection recess
219, 222 connection terminal
301 release device
303 pulling web
305 pulling lug
306 frame end
307 frame end
309 snapping element
311 snapping element
313 module element
315 lateral guide lug
317, 319 connection terminal
321, 323 connection terminal
401 module housing
403 module receptacle
405 module element
407, 409 connection terminal
411 module receptacle
413 module receptacle
415, 417 connection terminal
419 release device
421 ejection lever
423 ejection arm
425 ejection arm
427 pressing portion
429 pressing portion
431 slider
433 tip
501 module housing
503 module receptacle
505 module element
507 module receptacle
509 module element
511 release device
517 release device
519 ejection arm
521 ejection arm
523 pressing portion
525 pressing portion
527 frame portion
529 frame portion
531 bearing point
535 slider
537 slider
539 ejection tip
541 ejection tip
601 module element
603, 605 connection terminal
607, 609 connection terminal
611 release device
613 pressing portion
615 lever portion
617 center of rotation
618 notches
701 module element
703, 705 connection terminal
707, 709 connection terminal
711 release device
713 lever portion
715 lever portion
717 pressing portion
719 pressing portion
721 operating web
801 module housing
803 module receptacle
805 module element
807 module element
808 slide lug
809 release device
810 web
811 release device
813 slider
815 slider
817 module receptacle
819 undercut
821 undercut
823 undercut
825 undercut

826 guide opening
827 guide opening
829 pin receptacle
831 pin receptacle
833 pin
835 pivot shaft
837 pivot shaft
839 bottom
841 rounded bottom
901 module housing
903 module receptacle
905 module receptacle
907 module element
909 module element
915 reception channel
917 reception channel
919 reception channel
921 reception channel
923 guide cylinder
925 guide cylinder
927 guide cylinder
929 guide cylinder
931 ejection lever
933 tapered portion
935 tapered portion
1001 module housing
1003 module receptacle
1005 module receptacle
1007 module element
1009, 1011 connection terminal
1013, 1015 connection terminal
1017 reception recess
1019 reception recess
1021 reception recess
1023 reception recess
1025 reception channel
1027 release channel
1029 guide cylinder
1031 guide cylinder
1033 guide pin
1035 tapered portion
1037 elongated hole
1039 connection pin
1101 module housing
1103 module receptacle
1105 reception recess
1107 reception recess
1109 module element
1111, 1113 connection terminal
1115 line end
1117 line end
1119 pivot shaft
1121 rounded bottom
1123 rounded bottom
1125 rounded bottom
1126 snapping projection
1127 rounded bottom
1129 pin
1131 piece of wire
1133 opening
1201 pin
1203 helix
1204 tool
1205 module element
1209 module receptacle
1215 submodule element
1217 connection terminal
1219 submodule element
1221 connection terminal From the foregoing description, those skilled in the art can appreciate that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

The invention claimed is:

1. An electrical connection module, comprising:

a module housing including a module receptacle with a first electrical connection terminal;

a module element with a second electrical connection terminal and with a third electrical connection terminal, the module element being insertable into the module receptacle for electrically connecting the first connection terminal with the second connection terminal and retainable in the module receptacle by a releasable snap connection;

a release device for releasing the snap connection, wherein the release device comprises a rotatable pin with a helix, the helix acting on the module element upon a rotation of the pin for releasing the snap connection wherein the helix is configured such that the force of inserting the module element into the module receptacle would cause the helix to automatically screw-in the pin, and wherein the helix is configured to press the module element out of the module receptacle, upon a rotation of the pin by a predetermined angle of rotation.

2. The electrical connection module according to claim 1, wherein the module housing further includes an input-output terminal which is electrically connected with the first connection terminal.

3. The electrical connection module according to claim 1, wherein the first connection terminal, the second connection terminal and the third connection terminal respectively has a width of a pole.

4. The electrical connection module according to claim 1, wherein the module receptacle is delimited by two side walls.

5. The electrical connection module according claim 1, wherein the first connection terminal and the second connection terminal are electrically connectable by an electrical plug connection.

6. The electrical connection module according to claim 1, wherein the first connection terminal and the second connection terminal respectively include connection poles which are arranged one on top of the other.

7. The electrical connection module according to claim 1, wherein the third connection terminal is electrically connected with the second connection terminal and provided for releasably receiving electric lines.

8. The electrical connection module according to claim 1, wherein the third connection terminal includes electrical connection poles, which are arranged one below the other.

9. The electrical connection module according to claim 1, wherein for establishing the releasable snap connection at least one snapping projection or snapping receptacle arranged within the module receptacle and at least one snapping receptacle or snapping projection arranged on the module element are provided.

10. The electrical connection module according to claim 1, wherein the release device is provided to apply a force to the snap connection so as to release the snap connection.

11. The electrical connection module according to claim 1, wherein the helix interacts with the module element having a helix receptacle.

12. The electrical connection module according to claim 1, wherein the helix includes a first helix area having a helix pitch and a second helix area having a helix pitch, the first helix area being arranged above the second helix area.

13. The electrical connection module according to claim 1, wherein the helix is at least sectionwise circumferential.

14. The electrical connection module according to claim 1, wherein the helix is configured as a helical spring and a helical groove.

15. The electrical connection module according to claim 1, wherein the pin is received in an opening arranged in the module receptacle.

16. The electrical connection module according to claim 1, wherein the module element includes a first submodule element with a first connection terminal and a second submodule element with a second connection terminal, the pin being arranged between the first submodule element and the second submodule element.

17. The electrical connection module according to claim 16, wherein the pin is configured to act on the first submodule element and the second submodule element upon a rotation of the helix.

18. The electrical connection module according to claim 1, wherein the module housing includes a plurality of module receptacles including each a first electrical connection terminal;

a plurality of module elements including each a second electrical connection terminal and including each a third electrical connection terminal, each module element of the plurality of module elements being insertable into precisely one module receptacle for electrically connecting the first connection terminal with the second connection terminal and retainable in the module receptacle by a releasable snap connection, a release device for releasing the snap connection for each module element of the plurality of module elements.

19. The electrical connection module according to claim 18, wherein neighboring module receptacles are separated by a side wall.

20. The electrical connection module according to claim 1, wherein the module element includes at least one of the following elements: a relay, a relay socket, a coupling relay, a multi-pole plug, a rotation speed monitor, a safety module, an emergency stop module, a safety door circuit, a sensor, a safety sensor, a standstill monitor, a contactor, a passive isolator, a temperature transducer, an analog frequency converter, a position transducer, a switching amplifier, a limit switch, through terminals, a system power supply, a system adapter, an overvoltage protector, an isolating amplifier, a current transducer, and a safe-integrity-level function.

* * * * *